US006000331A

United States Patent [19]

Ota

[11] Patent Number: 6,000,331

[45] Date of Patent: Dec. 14, 1999

[54] METHOD FOR MAKING A STENCIL WITH A TWO PART ADHESIVE AND METHOD OF IMAGING WITH A THERMAL HEAD AND CLEANING SOLVENT

[75] Inventor: Yusuke Ota, Kyoto, Japan

[73] Assignees: Pigment Ota Ohtas Co., Ltd., Kyoto; Japan Digital Screen Co., Ltd., Osaka, both of Japan

[21] Appl. No.: 08/923,258

[22] Filed: Sep. 4, 1997

[30] Foreign Application Priority Data

Sep. 11, 1996 [JP] Japan ..... 8-263560

[51] Int. Cl.[6] ..... B41N 1/24

[52] U.S. Cl. ..... 101/128.21; 101/128.4

[58] Field of Search ..... 101/128.21, 128.4, 101/129, 425; 428/795

[56] References Cited

U.S. PATENT DOCUMENTS

| | | | |
|---|---|---|---|
| 4,584,363 | 4/1986 | Goel et al. | 528/73 |
| 4,777,213 | 10/1988 | Kanda et al. | 525/114 |
| 4,844,955 | 7/1989 | Graefe et al. | 428/420 |
| 4,934,391 | 6/1990 | Futch et al. | 134/40 |
| 4,961,377 | 10/1990 | Bando et al. | 101/128.21 |

FOREIGN PATENT DOCUMENTS

| | | | |
|---|---|---|---|
| 47-13493 | 9/1973 | Japan . | |
| 57-228863 | 7/1984 | Japan . | |
| 218893 | 12/1984 | Japan | 101/128.21 |
| 59-38425 | 9/1985 | Japan . | |
| 116595 | 6/1986 | Japan | 101/128.21 |
| 131098 | 6/1987 | Japan | 101/128.21 |
| 158798 | 7/1987 | Japan | 101/129 |

*Primary Examiner*—Stephen R. Funk
*Attorney, Agent, or Firm*—Snider & Chao, LLP; Ronald R. Snider

[57] ABSTRACT

A method for making a stencil for screen printing with a thermal head printer and method of using the same for plate making, uses a dot matrix of thermal head which is heated to obtain an image for printing for required letters, drawings and/or patterns by melting. Both watercolor inks and oil inks can be used. This stencil is composed of a polyester film and a diffusion screen substratum which are firmly adhered together by a two-part adhesive agent of unsaturated polyester resin containing amine and polyisocyanate resin.

4 Claims, 1 Drawing Sheet

METHOD FOR MAKING A STENCIL WITH A TWO PART ADHESIVE AND METHOD OF IMAGING WITH A THERMAL HEAD AND CLEANING SOLVENT

RELATED APPLICATION

This present disclosure relates to subject matter contained in Japanese Patent Application No.8-263560 (Filed on Sep. 11, 1997) which is expressly incorporated herein by reference in its entirety.

BACKGROUND OF THE INVENTION

1. Field of the Invention

This invention relates to a process stencil for screen printing with a thermal head printer and a method of using the same for plate making, wherein a thermoplastic resin film and a diffusion screen substratum are stuck together as the stencil on which processed or etched images for required letters, drawings and/or patterns are prepared by melting process caused by heat treatment on a dot matrix of a thermal printer. This stencil can be used for both watercolor inks and oil inks.

2. Description of Prior Art

It is a matter of common knowledge to adopt a thermographic screen process stencil in a light and heat system to produce an image for printing as follows. A thermoplastic resin film and a diffusion screen substratum made of polyester, nylon or silk material are stuck by an adhesive agent as a process stencil. An original artwork is placed on the surface of the thermoplastic resin, and then a flash light or an infrared ray with a temperature of 180°~200° C. is imposed thereupon from the face of the substratum. The imposed light or ray is absorbed into the artwork and it produces a heat temperature of 120°~130° C. This produced heat melts the thermoplastic resin and the adhesive agent, and finally a processed or etched image for printing is obtained.

The Japanese Gazette No.48-82921 for publication of unexamined patent applications discloses a method of a thermograpy, wherein a thermographic process stencil which is a combination of a vinyl group thermoplastic resin film and a porous substratum through which ink freely passes, on which is placed an original artwork. When a heat beam having 0.7~1.5 μm wave length is imposed the image of the original artwork is processed.

The Japanese Gazette NO. 59-115899 for publication of unexamined patent applications discloses a thermographic process stencil, wherein a polyester film having a thickness below 5 μm and a porous substratum composed mainly of a synthetic fiber are stuck together by an adhesive agent having its main component of methoxymethylized poliamide resin. An image for printing is obtained by an infrared ray radiation.

The thermographic process stencils as explained above are in general usable for watercolor and oil inks. However, when an image for printing is formed on the stencil, the beam is radiated all over the surface of the stencil so that undesirable portions, such as a stain on the original artwork, dust originally stuck on the stencil and the crossing points of the fiber produced on the substratum might be conveyed by the beam and reproduced thereupon. This invites many pinholes, which is a serious defect.

Different from a light and heat system, a thermographic screen process stencil in a thermal head printer system is also provided, wherein the thermal head is heated at its dot matrix portion and is contacted onto a thermoplastic resin film to melt the film with a temperature of 70°~90° C. for obtaining a processed image. This art is disclosed in detail by the Japanese Gazette No.60-180890 for publication of unexamined Patent Applications. A thermoplastic resin film in the thickness of 1~6 μm and a porous substratum are stuck together by an adhesive agent, and the heat is supplied on the dot matrix of the thermal head, so that a processed or etched image can be prepared for printing.

The process stencil to be used for the above thermal system is generally sold in the market and is guaranteed for durability of the thermal head below 90° C. temperature only. Therefore the thermoplastic resin film and the adhesive layer should be melted at a very low temperature, when compared with the stencil to be used for a light and heat system. Thus, it is necessary to use a very thin film and an adhesive agent which is to be melted in a low temperature. The adhesive to be melted in a low temperature has a quality of inferior heat resistance and also a quality of inferior oil resistance. After the very thin film and the agent to be melted in a low temperature are used together and the printing is finished, a mass of inks on the stencil should be removed by some removal agent. When the removal agent is used thereupon, the adhesive agent is easily melted, stripping the film from the substratum. Therefore repetitive printing cannot be performed. At the same time, as the adhesive to be melted in a low temperature is of inferior quality for oil resistance, this stencil cannot be used for oil inks. The stencil is used mainly for watercolor inks. The printings required on the acrylic plates, vinyl chloride plates and metal plates are available only with oil inks, and therefore, the present stencil method cannot be used on these printings.

If we try to process the light and heat system thermographic stencil with a thermal head system, it is impossible to prepare the image for printings. The heat of the thermal head cannot melt the thermoplastic resin film and the adhesive agent layer properly because the film is very thick and the temperature of this adhesive agent is higher.

Further, as explained before, in the light and heat system, many pinholes are unavoidable and, in the thermal head system, oil inks are not usable. Therefore, it is very difficult to adopt oil inks for screen printing. Accordingly, in the present situations, such printings are supplied by a photomechanical system which is very complicated and requires skilled manual labor.

SUMMARY OF THE INVENTION

This invention has an object to provide a process stencil for screen printing with a thermal head printer, wherein an image for printing is formed by a thermal system and the printing can be processed even with oil inks repeatedly.

In order to attain this object, the inventor has performed and repeated various studies and experiments.

The problems with which the present inventor confronted were as follows: First, it was required to develop a very thin thermoplastic resin film which can be melted and form an image for printing at as low in temperature as possible, so that a thermal head may be well maintained during its working time to produce the image for printing by generating heat. When the film is very thin, it is feared that the thermoplastic resin may be shrunken and transformed during the process where the thermoplastic resin film and the diffusion screen substratum are stuck together in a heating and drying room where temperatures are from 50° C. to 70° C. Secondly, it is important to select an adhesive agent properly. The agent is required to be insoluble with oil inks and also insoluble with removal agents used for wiping the inks out. It is also to be guaranteed to be non-stripping to perform repetitive printings. In general, the adhesive agent has the quality where the stronger its oil resistance is, the stronger its heat resistance becomes, because its melting point is higher, while the weaker its oil resistance is, the weaker its heat resistance becomes, because its melting point is lower. In order to eliminate these defects, the inventor has repeated his trials and errors under his continual tests and experiments. As a result, he has obtained his remarkable knowledge that he has overcome the explained defects by the following constitution. He adopted a polyester film as the thermoplastic resin film having a relative thickness from 1.5 μm to 2 μm, while as an adhesive agent, he adopted a two-part adhesive of unsaturated polyester resin including amine and polyisocyanate resin as a hardening agent. Next, the polyester film and a diffusion screen substratum were stuck together, and the composition was dried under 40° C. which is a slower drying speed than usual. The melting was realized with the heat of 40~90° C. supplied on the thermal head to form the image for printing. Also oil inks could be used with enough strength.

In other words, the stencil paper for screen printing with the thermal head developed by the present invention comprises the thermoplastic resin film and the diffusion screen substratum stuck by the adhesive agent. The film and the adhesive layer are melted to form the image for printing, and thus required letters, drawings and/or patterns can be desirably obtained. The film used is a polyester film with a thickness from 1.5 μm to 2 μm, and the adhesive layer is composed of unsaturated polyester resin including amine and polyisocyanate resin as its hardening agent.

At the same time, the present invention provides an additional device to form a thin silicone membrane over the surface of 1.5 μm~2 μm polyester film.

As a method of using a process stencil for screen printing with a thermal head printer for a plate making, a 1.5 μm~2 μm thick polyester film is adhered to a polyester substratum by a two-part adhesive agent composed of unsaturated polyester resin including amine and polyisocyanate resin as a hardening agent. A thermal head with a heated dot matrix is placed in contact with the polyester film, whereby some required letters, designs and/or patterns are melted to form an image for printing. When the melting with image forming is finished, solvent dust clogged on the polyester substratum is removed by cyclohexanone, methyl ethyl ketone (hereinafter referred as "MEK"), or mixed liquids of said two substances.

As another method of using the same for the plate making, a 1.5 μm~2 μm thick polyester film is adhered to a nylon substratum by a two-part adhesive agent composed of unsaturated polyester resin including amine and polyisocyanate resin as a hardening agent, and onto the polyester film a thermal head with a heated dot matrix is placed in contact with the polyester film, whereby required letters, designs and/or patterns are melted to form an image for printing. When the printing is finished, solvent dust clogged on the polyester substratum are removed by acetone or acetic ester.

BRIEF DESCRIPTIONS OF THE DRAWINGS

DESCRIPTIONS OF THE PREFERRED EMBODIMENT

Now, the preferred embodiment is explained hereunder.

Figure 1:
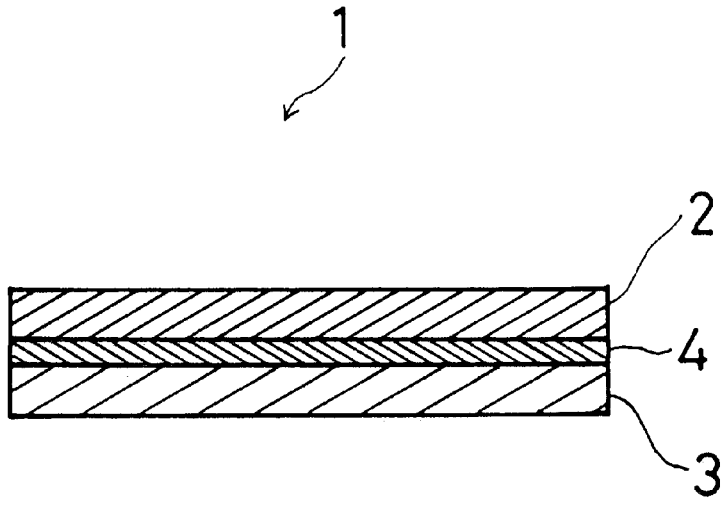
FIG. 1 is a longitudinal sectional view of a process stencil for screen printing with a thermal head printer developed by the present invention.

With reference to FIG. 1, the numeral 1 is a process stencil for screen printing with a thermal head printer, whereby heat supplied on the thermal head works to melt a polyester film and an adhesive agent to form an image for printing to reproduce some required letters, drawings and/or patterns. The process stencil (1) comprises a polyester film (2) with its thickness from 1.5 μm to 2 μm and a diffusion screen substratum (3) and an adhesive agent (4). The film (2) and the substratum (3) are stuck together by the adhesive agent (4) which is a two-part adhesive composed of unsaturated polyester resin including amine and polyisocyanate resin as a hardening agent.

The construction of this process stencil (1) is now explained in detail as follows. The film (2) has a thickness from 1.5 μm to 2 μm, because a thickness below 1.5 μm is easily broken when it is pressingly stuck with the substratum (3), while a thickness over 2 μm when melted by heat of a thermal head makes image forming for printing difficult.

It is preferable to adopt a polyester film (2) which starts to melt and transform at 40~90° C. so that the heat of operation of the thermal head is restricted below 90° C. This allows thermal heads in the general market to be adopted. Further, when a film (2) which starts to melt and transform at 40~70° C. is adopted, the burden imposed on the thermal head is greatly decreased.

In the case where the film (2) starts to melt and transform at below 40° C., when the film (2) is dried in the temperature of below 35~40° C., the film shrinks and transforms during this drying procedure. When we check films on the market which meet this condition, we have found two articles which are sold by Kabushiki Kaisha Mitsubishi Dia Foil Heckist, and they are article No. K-190 which starts to transform at 50° C. and article No. K-920 which starts to transform at 40° C. These two polyester films can be adopted for the present invention.

As a diffusion screen substratum (3), a polyester substratum, a nylon substratum or a silk substratum with a thickness of 50 μm~80 μm sold in the market has been adopted.

The adhesive agent (4) to be used in this invention is a two-part adhesive of unsaturated polyester resin including amine as a main agent and polyisocyanate resin as a hardening agent. It is quite proper to adopt the two-part adhesive, article number MT-100 sold in the market and which is supplied by Sanwa Bunshi Kogyo Kabushiki Kaisha located at Nara city in Nara Prefecture, Japan. The main agent of this adhesive is composed of 25% of denatured polyester block polymer, 48% of ethylacetate, 20% of methyl ethyl ketone, 7% of toluene, and a small quantity of complex amine. The chemical formula of said denatured polyester block polymer is shown as follows:

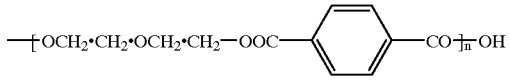

The hardening agent is composed of 70% of polyisocyanate resin, 30% of ethyl acetate, and the chemical formula of said polyisocyanate resin is as follows:

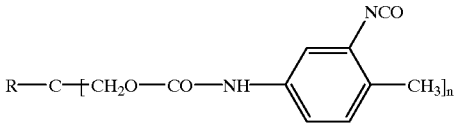

The actual field test was performed with the following data:

Adhesive Agent (4): The Article No. M-100 as explained.

Film (2) with 1.5 μm thickness : The article No. K-920 as explained.

Substratum (3) with 58 μm thickness: Polyester substratum.

The article No. M-100 adhesive was tested in the following proportions:

1 (main agent) :0.1~0.4 (hardening agent): 2~8 (diluent-acetic ester).

The testing process stencil was soaked into oil ink solvent for three days and then adhesive durability was carefully checked.

The used solvent was article name of "Vini-8 solvent" sold by Kabushiki Kaisha Nagase Screen Printing Laboratory.

Heat-resistance was checked by a thermal printer whose article Number was SLK250/300 supplied by Graphtec Kabushiki Kaisha, which had an increasing temperature up to 350° C. while the thermal head had a starting temperature at about 70° C. The melting result and processing the image for printing was checked with this thermal printer.

For Adhesive Durability

× Stripped off completely

Δ To be stripped off by manual work

○ Durable for more than 50 times screen printings with oil inks

◎ Durable for more than 100 times screen printings with oil inks.

For Heat-Resistance

× melting does not occur.

Δ melting happens for only small and slim letters.

○ melting happens for both for small and big letters.

◎ melting happens for big letters and solid color faces.

The test result is shown in Table 1 and Table 2 respectively as follows:

TABLE 1

| Main Agent | Hardening Agent | Diluent | Adhesive durability | Heat-Resist |
|---|---|---|---|---|
| 1 | 0.1 | 2 | ◎ | X |
| 1 | 0.1 | 3 | ○ | X |
| 1 | 0.1 | 4 | ○ | Δ |
| 1 | 0.1 | 5 | ○ | ○ |
| 1 | 0.1 | 6 | ○ | ○ |
| 1 | 0.1 | 7 | Δ | ◎ |
| 1 | 0.1 | 8 | X | ◎ |
| 1 | 0.2 | 4 | ◎ | Δ |
| 1 | 0.2 | 5 | ○ | ○ |
| 1 | 0.2 | 6 | ○ | ◎ |
| 1 | 0.2 | 7 | Δ | ◎ |

TABLE 2

| Main Agent | Hardening Agent | Diluent | Adhesive durability | Heat-Resist |
|---|---|---|---|---|
| 1 | 0.3 | 4 | ◎ | Δ |
| 1 | 0.3 | 5 | ◎ | ○ |
| 1 | 0.3 | 6 | ○ | ◎ |
| 1 | 0.3 | 7 | Δ | ◎ |
| 1 | 0.4 | 4 | ◎ | Δ |
| 1 | 0.4 | 5 | ◎ | ○ |
| 1 | 0.4 | 6 | ○ | ◎ |
| 1 | 0.4 | 7 | ○ | ◎ |

As shown in the above Table 1 and Table 2, when we adopted the proportions 1 (Main Agent) : 0.1~0.4 (Hardening Agent) 5~6 (Diluent), a satisfactory result was obtained.

Now, it is explained how to obtain a process stencil and how to make a process plate.

In the beginning, an adhesive agent (4) is prepared under proper adjustment by the following method: unsaturated polyester resin including amine diluted with a solvent (the main agent of the article No. MT-100) and polyisocyanate resin which is also diluted with a solvent (the hardening agent of the article MT-100) are mixed together with a diluent of acetic ester.

Then, the adhesive agent (4) is coated over surface of a diffusion screen substratum (3) by a wet laminating machine, and a polyester film (2) is fitted thereon. The fitted material (3 and 4) is then pressed with a cylindrical rolling machine. Because the adhesive agent (4) is a type of two-part adhesive, this procedure can be treated in a smooth manner.

Finally, the polyester film layer (2), an adhesive agent layer (4) and a substratum layer (3) are supplied to a drying roller at a required temperature which does not shrink or transform the material. The adhesive is then completely dried out and the desirable stencil (1) is obtained.

As an auxiliary procedure, when obtained material is furnished with a strong wind by a large fan and it is again supplied through a pressing roller set to 3 ATM (ATM= Atmospheric Pressure, 1 ATM=760 mmHg), the diluent can be completely dried out.

In order to make the plate, the obtained stencil (1) is set with a thermal printer. An image datum is prepared by an application software for a dot matrix of a thermal head which is heated to melt the polyester film (2) and the adhesive agent (4) to produce an image for printing thereon.

Then, solvent dust clogged on the substratum (3) is removed by acetic ester, cyclohexanone, toluene, acetone, MEK or xyelene, and thus the desirable plate for printing is attained.

It is preferable to adopt about 3 ATM to stick the polyester film (2) and the substratum (3) with the adhesive agent (4). Below 2 ATM, the layer of the adhesive agent (4) is formed thicker against the substratum, while over 4 ATM, the polyester film (2) is broken to adhere the roller base because the film (2) is very thin. With regard to the temperature of the drying roller, it is preferably about 35° C.

Even if solvent dust is clogged on the polyester film (2) and the adhesive agent (4), the obtained image for printing can be usable for normal printing because oil inks penetrate deeply. However, if the polyester substratum (3) is adopted, it is preferable to remove the dust with cyclohexanone, MEK or a mixed solution of cyclohexanone and MEK. If the nylon substratum (3) is adopted, it is also preferable to remove the dust with acetone or acetic ester, so that an image for good printing can be attained.

In this invention, the process stencil (1) is composed of the polyester film (2) which has 1.5 μm~2 μm thickness which transforms and melts at a temperature of 40°~90° C. The diffusion screen substratum (3) and the film (2) are stuck by the adhesive agent (4) which is not melted substantially into the oil ink solvent. Therefore, even below 90° C. which is the maximum guaranteed temperature for the durability of the thermal head, the polyester film (2) and the two-part adhesive is melted to produce the image for printing, which realizes desirable printing for required letters, drawings and/or patterns.

In the process stencil developed by this invention, when the required letters, drawings and/or patterns are formed in the application software a formation signal is conveyed to the thermal printer through a personal computer and the image for printing is produced on the process stencil. Therefore, it is not necessary to adopt the photomechanical plate making.

Now, another embodiment for the present invention is explained.

Figure 2:
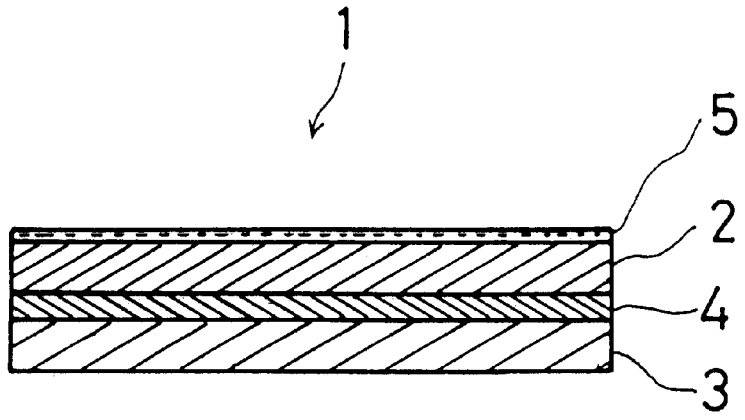
FIG. 2 is a longitudinal sectional view of the process stencil, wherein a thin silicone membrane is furnished over a polyester film.

According to FIG. 2, a thin silicon membrane (5) was supplied on a polyester film (2), so that friction between a thermal head and the film (2) was eliminated and generation of static electricity was prevented.

The article number K-920 as previously explained was adopted as the polyester film (2), having a 1.5 μm thickness and a transformable and melting temperature at 40° C.~50° C. As a diffusion screen substratum (3), a polyester substratum having a 58 μm thickness and a 62.5 cm width, supplied and marketed by Nihon Special Fabrics Kabushiki Kaisha under the article No. 2550-Mesh, was adopted. As an adhesive agent (4), a two-part adhesive of the article number TM-100 as previously explained was adopted. This agent (4) was mixed under the proportion of 1 (Main agent):0.3 (Hardening agent):6 (Diluent) respectively. As a silicone membrane (5), a sliding silicone solution composed of 10% silicone and 90% toluene marketed by Miyako Kasei Kabushiki Kaisha was adopted. In order to stick the film (2) and the substratum (3), a wet laminating machine was used.

The polyester substratum (3) was dipped into the adhesive tub of the wet laminating machine and was operated to run at 10.5 seconds per meter, and thus adhesive agents (4) are coated with the substratum (3). Then, the polyester film (2) was placed on the substratum (3), and then the film (2) and the substratum (3) were passed through the cylindrical and pressing roller preset at 3 ATM.

After this procedure, the topped material composed of the film (2), the substratum (3) and the adhesive agent (4) was conveyed to a drying roller with surface temperature at 35° C., and at the terminal point of this roller the material was further dried by strong wind of a large fan, and in succession the material ran again through the pressing roller at 3 ATM, which removed the diluent.

Finally, the sliding silicone solution (5) was coated over the film (2) at 10 grams per meter, and when the solution was dried, the process stencil with 78 μm thickness was obtained.

This process stencil was set to a thermal printer of the article No. SLK250/350 supplied by Graphtec Kabushiki Kaisha and was contacted to a thermal head. Based on the image datum preset on a application software, a dot matrix of the thermal head was heated at 70° C., so that the polyester film (2) and the layer of the adhesive agent were melted to form an image for printing. Solvent dust clogged on the polyester substratum (3) was removed with cyclohexanone, and the printing and original stencil paper was obtained.

With this original paper, 1000 pieces of paper were treated with the screen printing, using oil ink of the article name "AAA" supplied by Kabushiki Kaisha Nagase Screen Printing Laboratory, and when printing was finished, remaining ink was removed by the article name "AAA Solvent" supplied also by Kabushiki Kaisha Nagase Screen Printing Laboratory for checking whether it was available for repetitive printings. The checking result was quite satisfactory. Furthermore, printings were repeated at plural times, and remaining ink was also removed as above. Even so, the checking result showed conditions satisfactory for further repetitions.

With the same original paper, 100 pieces of plate glasses were treated with the screen printing, using oil ink developed for glass printing supplied by the same Laboratory, and when relative printing was finished, remaining ink was removed by the article name of "Eight Solvent" supplied by the Laboratory for checking purposes. The result was satisfactory for repetitive printings. The same experiments were repeated for plural times using the same, and satisfactory results were obtained therefrom.

At the same time, with this original stencil, 300 pieces of vinyl sheets were treated with the screen printing, using oil ink developed for vinyl sheet supplied by the Laboratory, and when the printing was finished, remaining ink was removed by said "Eight Solvent" for checking purposes. The same checks were repeated, and the result was quite satisfactory, exactly same as with paper printings and plate glass printings.

As explained so far, according to the present invention, an image for printing is easily formed on the screen process stencil paper by the thermal system, using oil inks, and moreover the original stencil paper can be used in repetitive usages without any problem at all. This invention, thus, benefits the industrial applicability in a large scale.

It is further understood by those skilled in the art that the foregoing description is a preferred embodiment of the disclosed invention and that various changes and modifications may be made in the invention without departing from the spirit and scope thereof.

What is claimed is:

1. A method for making a stencil for screen printing with a thermal head printer, comprising the steps of:

adhering a thermoplastic resin film and a diffusion screen substratum together by an adhesive agent;

melting the thermoplastic resin film and a layer of the adhesive agent by heat of a thermal head to form an image for printing;

wherein the thermoplastic film is composed of a polyester film having a thickness from 1.5 μm to 2 μm; and wherein the layer of the adhesive agent is composed of unsaturated polyester resin including amine and polyisocyanate resin.

2. A method for making a stencil according to claim 1, further comprising coating a thin silicone membrane over a surface of the polyester film having a thickness from 1.5 μm to 2 μm.

3. Method of using a process stencil for screen printing with a thermal head printer for plate making, comprising the steps of:

contacting a thermal head onto a surface of a polyester film of a process stencil for screen printing with the thermal head printer, wherein the process stencil is provided by adhering the polyester film which has a thickness from 1.5 μm to 2 μm and a diffusion screen polyester substratum with a two-part adhesive agent composed of unsaturated polyester resin including amine and polyisocyanate resin;

melting the polyester film and a layer of the adhesive agent by heat which is generated by a dot matrix of the thermal head to form an image for printing; and removing a solvent dust clogged on the polyester substratum with cyclohexanone, methyl ethyl ketone, or mixed solutions of cyclohexanone and methyl ethyl ketone.

4. Method of using a process stencil for screen printing with a thermal head printer for plate making, comprising the steps of:

contacting a thermal head onto a surface of a polyester film of a process stencil for screen printing with the thermal head printer, wherein the process stencil is provided by adhering the polyester film which has a thickness from 1.5 $\mu$m to 2 $\mu$m and a diffusion screen nylon substratum with a two-part adhesive agent composed of unsaturated polyester resin including amine and polyisocyanate resin;

melting the polyester film and a layer of the adhesive agent by heat which is generated by a dot matrix of the thermal head to form an image for printing; and removing a solvent dust clogged on the nylon substratum with acetone or acetic ester.

* * * * *